US009049977B2

(12) United States Patent
Jobst et al.

(10) Patent No.: US 9,049,977 B2
(45) Date of Patent: Jun. 9, 2015

(54) DISHWASHER

(75) Inventors: Johann Jobst, Regenstauf (DE); Thomas Wachinger, Altomünster (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 876 days.

(21) Appl. No.: 13/286,250

(22) Filed: Nov. 1, 2011

(65) Prior Publication Data

US 2012/0104914 A1 May 3, 2012

(30) Foreign Application Priority Data

Nov. 3, 2010 (DE) ..... 10 2010 043 272

(51) Int. Cl.
*B08B 3/00* (2006.01)
*A47L 15/50* (2006.01)

(52) U.S. Cl.
CPC ..... *A47L 15/507* (2013.01)

(58) Field of Classification Search
CPC ... A47L 15/507; A47L 15/504; A47L 15/503; A47L 15/505; A47L 15/502
USPC ..... 134/135, 137, 56 D, 57 D, 58 D, 164, 134/165, 145; 312/228.1, 319.1, 311, 312/334.8, 408, 334, 319.2; 211/41.8, 41.9, 211/162, 150, 41.3
See application file for complete search history.

(56) References Cited

U.S. PATENT DOCUMENTS

| | | | | |
|---|---|---|---|---|
| 1,816,213 | A | 7/1931 | Duke | |
| 4,983,000 | A | 1/1991 | Roeck | |
| 6,932,511 | B2 | 8/2005 | Doornbos et al. | |
| 2005/0150523 | A1 * | 7/2005 | Schock | 134/25.2 |
| 2008/0129168 | A1 * | 6/2008 | Banta et al. | 312/333 |
| 2011/0031863 | A1 * | 2/2011 | Benitsch et al. | 312/408 |

FOREIGN PATENT DOCUMENTS

| | | |
|---|---|---|
| JP | 2002301006 | 10/2002 |
| KR | 1020070020833 | 2/2007 |

* cited by examiner

*Primary Examiner* — Michael Barr
*Assistant Examiner* — Thomas Bucci
(74) *Attorney, Agent, or Firm* — James E. Howard; Andre Pallapies

(57) ABSTRACT

A dishwasher, in particular a household dishwasher, includes at least one wash compartment and a rack guide rail for support in the wash compartment of a rack which holds items to be washed and/or dried. The rack guide rail has a running surface to allow movement of the rack in and out of the wash compartment for loading and unloading purposes along a travel path supported on the running surface. The rack guide rail is hereby supported at a support point for pivoting about a pivot axis.

29 Claims, 3 Drawing Sheets

DISHWASHER

BACKGROUND OF THE INVENTION

The invention relates to a dishwasher, in particular a household dishwasher, having at least one wash compartment, in which at least one rack is provided to hold items to be washed and/or dried, which for loading and unloading purposes can be moved in and out of the wash compartment along a travel path supported on a running surface, the running surface being assigned to a rack guide rail, on which the rack is supported in such a manner that it can move along the travel path.

US 2005/0150523 A1 discloses a dishwasher, in which a rack can be moved out of or into the wash container by way of a telescopic rail system. However an operator has to take action in each instance to displace the rack out of or into the wash container.

BRIEF SUMMARY OF THE INVENTION

It is therefore an object of the invention to provide a dishwasher, which is easier to use.

According to the invention provision is made for the rack guide rail to be supported on a support point in such a manner that it can pivot about the pivot axis. The rack guide rail is lowered by pivoting the rack guide rail about the pivot axis. This means that a first segment of the rack guide rail is lowered, when viewed in its longitudinal extension, and a second is raised, with the result that the rack guide rail is displaced for example from its initial position—in which the rack is essentially stable in respect of movement—into a first pivot position, which corresponds to a move-out position. In this move-out position the rack guide rail is pivoted so that the rack moves out automatically due to the action of gravity. Of course it may also be possible to move the rack guide rail into a second pivot position, in particular a move-in position, in which the rack moves into the wash compartment automatically or at least with assistance. Suitable selection of the pivot axis, about which the rack guide rail is pivotably supported allows the pivoting of the rack guide rail to be achieved with little energy outlay or force outlay.

Provision is preferably made for it to be possible to move the running surface from a for example essentially gradient-free neutral position by pivoting about a pivot axis into an oblique position having a gradient, in which the rack moves out of the wash compartment due to gravity. This means for example that the rack loaded with items to be washed in the gradient-free neutral position can be pushed into the wash compartment with little force outlay, while in the oblique position it moves in and/or out automatically due to the gradient.

With automatic moving in and/or out the rack is made to move completely automatically, while with assisted moving in and/or out an operator for example has to overcome a breakaway torque to make the rack move. Provision can be made to provide for assisted moving out for the purposes of moving out for example, in other words an operator must overcome a breakaway torque, while for the purposes of moving in, provision is made for automatic moving in, with no breakaway torque having to be overcome. Any other combination is of course also possible. Provision can be made here for the rack guide rail to be pivoted through two different angles. However identical angles can also be used.

The running surface here is preferably supported so that it can be at least partially lowered, compared with the running surface in a neutral position, which is an essentially, i.e. within normal manufacturing tolerances, flat, i.e. gradient-free running surface in the use position of the dishwasher, so that in the neutral position of the running surface there is no movement of the rack due to gravity. The raising of the entire rack filled with items to be washed is therefore avoided. This reduces the force outlay, so that a drive unit for displacing the running surface can have smaller dimensions.

The rack guide rail and therefore also the rack, which is supported by this so that it can be moved in and out, are at least partially lowered. The partial lowering of the rack guide rail produces a gradient, due to which the rack can move in or out automatically due to the action of gravity. At the end of a wash program run the rack is frequently fully loaded when it is moved out, so that its weight, including the weight of the items that have been washed and are disposed on the rack, is very heavy. In contrast to move the rack in, provision can be made for the rack guide rail to be raised, since the washed items have been taken out of the rack so the rack is now lighter. Such raising takes place either to displace the rack guide rail out of the lowered position after the rack has been moved out back into its initial position or to displace the rack guide rail out beyond the initial position, in order additionally to be able to move the rack into the wash compartment automatically or at least in an assisted manner. Automatic moving out of the rack is therefore possible, in particular after the end of a wash program run, along with an automatic moving in of the emptied rack.

In one development of the invention provision is made for the rack guide rail to have a further, second support point at least on one of its end segments. The rack guide rail therefore has at least one second support point in addition to its rotation point disposed in the center region. This additional support point can be disposed either on its front end segment, in other words in front of the rotation point in the pull-out direction, and/or its rear end segment, in other words behind the rotation point of the pivot axis in the pull-out direction, thereby generally providing a stable structure.

In one development of the invention provision is made for the point of rotation of the pivot axis to be disposed in the center region of the longitudinal extension of the wash compartment in the direction of the travel path of the rack. When the rack is pushed or moved into the wash compartment, the pivot axis or its rotation point is therefore not only in the center region of the rack guide rail but also at least close to a center of gravity of the rack in the longitudinal direction of the rack guide rail. Therefore a major force outlay is not required to pivot or lower the rack guide rail, since ideally the system—consisting of the rack guide rail and the rack containing items to be washed—is in equilibrium in respect of the pivot axis when it is pushed into the wash compartment. Therefore a particularly small force outlay is required to move the rack or the rack guide rail in the desired manner into an oblique position, in which the rack moves in or out automatically due to the action of gravity. When the dishwasher has completed a wash operation, it is therefore possible to move the loaded rack together with the washed items out in a simple manner and without too great a force outlay, since the force required to lower or raise the rack guide rail is comparatively small. In order to keep the force outlay of an operator required to displace the rack guide rail as small as possible, provision can be made to displace the rack guide rail back into the initial position, after the rack has been moved out and unloaded, before the rack is reloaded with new items to be washed. This can be initiated manually by an operator and brought about by means of an actuator, which has a corresponding active connection to the rack guide rail. Alternatively displacement of the rack guide rail can also be brought about manually.

In one development of the invention provision is made for the rack guide rail to have a roller guide for example running along its longitudinal extension, in which at least one fixed roller having an axis of rotation is guided, the axis of rotation forming the pivot axis. The pivoting of the rack on the rack guide rail or the pivoting of the rack guide rail therefore takes place about the axis of rotation of the roller, since the axis of rotation of the roller forms the pivot axis. The roller here is supported in a rotatable manner in the wash compartment on the housing of the dishwasher. When the roller is displaced in a suitable manner, the rack guide rail is displaced from the initial position into one of the pivot positions, so that the moving in and/or out of the rack is at least partially automatic or assisted. Several, at least two rollers some distance apart are preferably provided and engage in the roller guide. Provision can be made here for one of the rollers to be rotatable but fixed in position and the other roller to be displaceable. Similarly of course both or all the rollers can be displaceable to bring about the pivoting or displacement of the rack guide rail.

In one development of the invention provision is made for the roller to be supported in a rotatable manner on the housing of the dishwasher. As set out above, the roller is guided in a fixed manner in the roller guide running along the longitudinal extension of the rack guide rail. In order to allow the rack guide rail and therefore the rack to be pulled out in a simple manner, the roller is supported rotatably to keep the force required to move the rack in or out as small as possible.

In one development of the invention provision is made for a second roller to be supported in a height-adjustable manner on the housing of the dishwasher. It should therefore be possible to set the height at which the roller is positioned in relation to the housing. By setting the height of the roller it is possible to achieve the at least partial lowering of the rack guide rail and the raising thereof. Corresponding displacement of the roller therefore allows the rack guide rail to be displaced at least between the initial position and the at least one pivot position, in particular the move-out position. The pivot operation here takes place in such a manner that the roller is displaced heightwise relative to the housing, in other words is for example lowered or raised.

Provision is preferably made here for the second roller to be disposed at a minimum distance from the fixed roller in the direction of the pre-guidance path, so that lowering can be brought about by changing the position of the second roller. The minimum distance here can be a multiple of the diameter of the first or second roller.

In one development of the invention provision is made for the pivoting, in particular the oblique positioning of the rack guide rail or the heightwise displacement of the roller to take place by means of an actuator, in particular a servomotor and/or an electromagnet. The oblique positioning of the rack guide rail here is achieved in particular by the at least partial lowering. With the actuator it is possible to bring about the oblique positioning of the rack guide rail or the heightwise displacement of the roller entirely without force outlay on the part of the user of the dishwasher. To move the rack in and/or out therefore the actuator first displaces the rack guide rail or the roller accordingly, so that a gradient results, due to which the rack moves out of or into the wash compartment. The actuator can be formed by the servomotor and/or the electromagnet for example. These can advantageously be integrated in the housing of the dishwasher. The actuator is activated by way of a control and/or regulating facility. This is connected for example to an operating element, by way of which the user of the dishwasher can initiate the movement of the rack into or out of the wash compartment. The operating element is provided on the dishwasher anyway, for example to select a wash program.

In one development of the invention provision is made for a rack movement brought about by the oblique positioning of the rack guide rail to be slowed by means of at least one eddy current brake and/or a gas pressure damper facility and/or a hydraulic damper facility. The rack guide rail can therefore be slowed by means of a brake facility. The brake facility here can feature the eddy current brake, the gas pressure damper facility or the oil pressure damper facility. The brake facility prevents the rack, in particular the loaded rack, striking an end stop or a stop element at too high a speed in an undesirable manner as it moves in or out. In some instances this could cause unwanted damage to the items in the rack. The brake facility reduces the speed of the rack as it moves in or out, thereby reducing its impetus. This prevents it striking or coming up against the stop element or the housing of the dishwasher too forcefully.

In one development of the invention provision is made for the rack to be configured as a top rack or cutlery holder, the cutlery holder being configured for example to hold cutlery such as knives, forks or spoons horizontally. This means that the rack is not disposed directly above a base of the wash compartment of the dishwasher. Instead the top rack is provided offset from the base. In addition to the top rack further racks or a cutlery holder can be assigned to the dishwasher. A rack configured as a bottom rack can be disposed in the region of the base of the interior. The top rack(s) is/are positioned vertically above the bottom rack (if there is one).

In one development provision is made for it to be possible to raise the running surface at least partially. This allows an inward movement into the wash compartment to be brought about in addition to, for example, an outward movement out of the wash compartment or vice versa, so that it is possible to move a rack into or out of a wash compartment of a dishwasher completely automatically without force outlay on the part of an operator.

The invention also includes a rack guide rail for an inventive dishwasher, which can be configured as a household dishwasher.

BRIEF DESCRIPTION OF THE DRAWINGS

The invention is described in more detail below with reference to the exemplary embodiments illustrated in the drawing, without hereby restricting the invention. In the drawing.

DETAILED DESCRIPTION OF EXEMPLARY EMBODIMENTS OF THE PRESENT INVENTION

Figure 1:
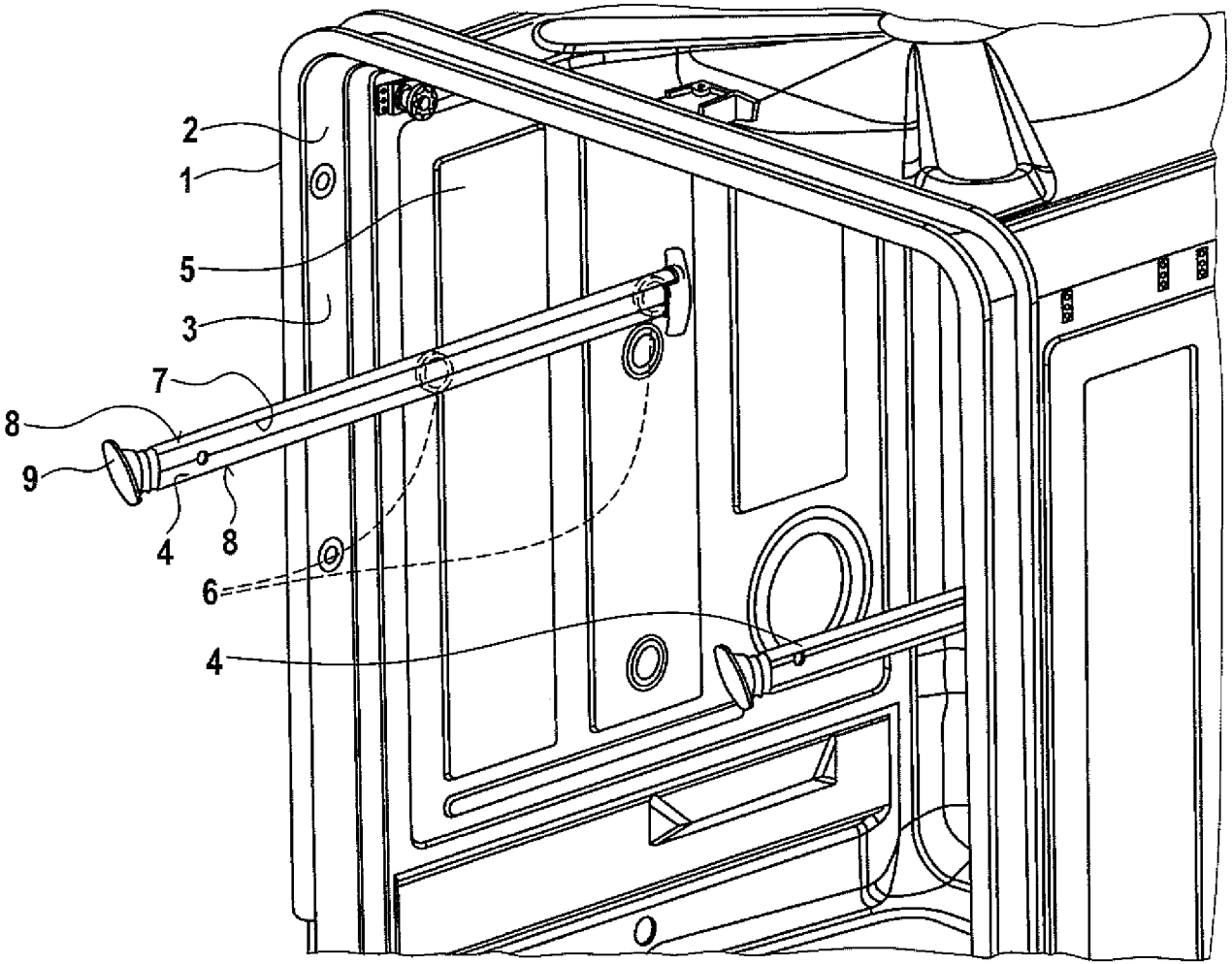
FIG. 1 shows a dishwasher with a pivotable rack guide rail.

FIG. 1 shows a dishwasher 1, which in the present exemplary embodiment is configured as a household dishwasher. The dishwasher 1 has a wash compartment 2, which is at least partially enclosed by a housing 3 of the dishwasher 1. FIG. 1 shows that the wash compartment 2 has a front opening, which can be closed with a door or cover (not shown). Disposed in the wash compartment 2 is at least one rack. To hold or guide the rack the dishwasher 1 has rack guide rails 4, which in the present exemplary embodiment are configured as telescopic and are disposed opposite one another at the same height on inner walls 5 of the wash compartment 2. The rack guide rails 4 here are supported respectively by means of two rollers 6 supported on the inner walls 5. The rollers 6 engage in a roller guide 7 of the rack guide rail 4 and rest against at least one arm of a C-shaped profile of the rack guide rail 4 or the roller guide 7. The rollers 6 are disposed at a distance from one another, so that the rack guide rail is held in such a manner that it cannot tilt in relation to the rollers 6. The rollers 6 are supported in a rotatable manner on the inner wall 5. It is thus possible to displace the roller guide 7 in its longitudinal direction in relation to the rollers 6, in other words along a travel path out of and into the wash compartment 2. The rack guide rail 4 is therefore guided in such a manner that it can be displaced on the rollers 6.

The roller guide 7 has at least one running surface 8, on which the rack is disposed in such a manner that it can also be displaced in the longitudinal direction of the rack guide rail 4. In the illustrated exemplary embodiment two running surfaces 8 are provided, with one of the running surfaces 8 being disposed above and the other of the running surfaces 8 being disposed below the C-shaped profile of the rack guide rail 4. The rack can be held on these running surfaces 8 for example in such a manner that it can be displaced with rollers (also not shown) assigned to it. The rollers of the rack here engage around the rack guide rail 4, so that one of the rollers establishes an active connection to the top running surface 8 and another of the rollers establishes an active connection to the bottom running surface 8. This secures the rack so that it cannot be removed or fall out inadvertently.

At its front end at least the rack guide rail 4 has a stop element 9, which serves as a path limiter. FIG. 1 shows that a corresponding stop element (not described in detail here) is also provided at the rear end. This produces a rack arrangement, in which the rack can be displaced in the longitudinal direction of the rack guide rail 4 in relation to this and also the rack guide rail 4 can be displaced in relation to the housing 3 of the dishwasher 1. Provision is generally made here, when the rack is moved out of the wash compartment 2, for the rack first to be displaced in relation to the rack guide rail 4, until a region of the rack (for example its rollers) comes into contact with the stop element 9. From this point further outward movement of the rack from the wash compartment 2 brings about a displacement of the rack guide rail 4, while the rack moves no further in relation to this.

Figure 2:
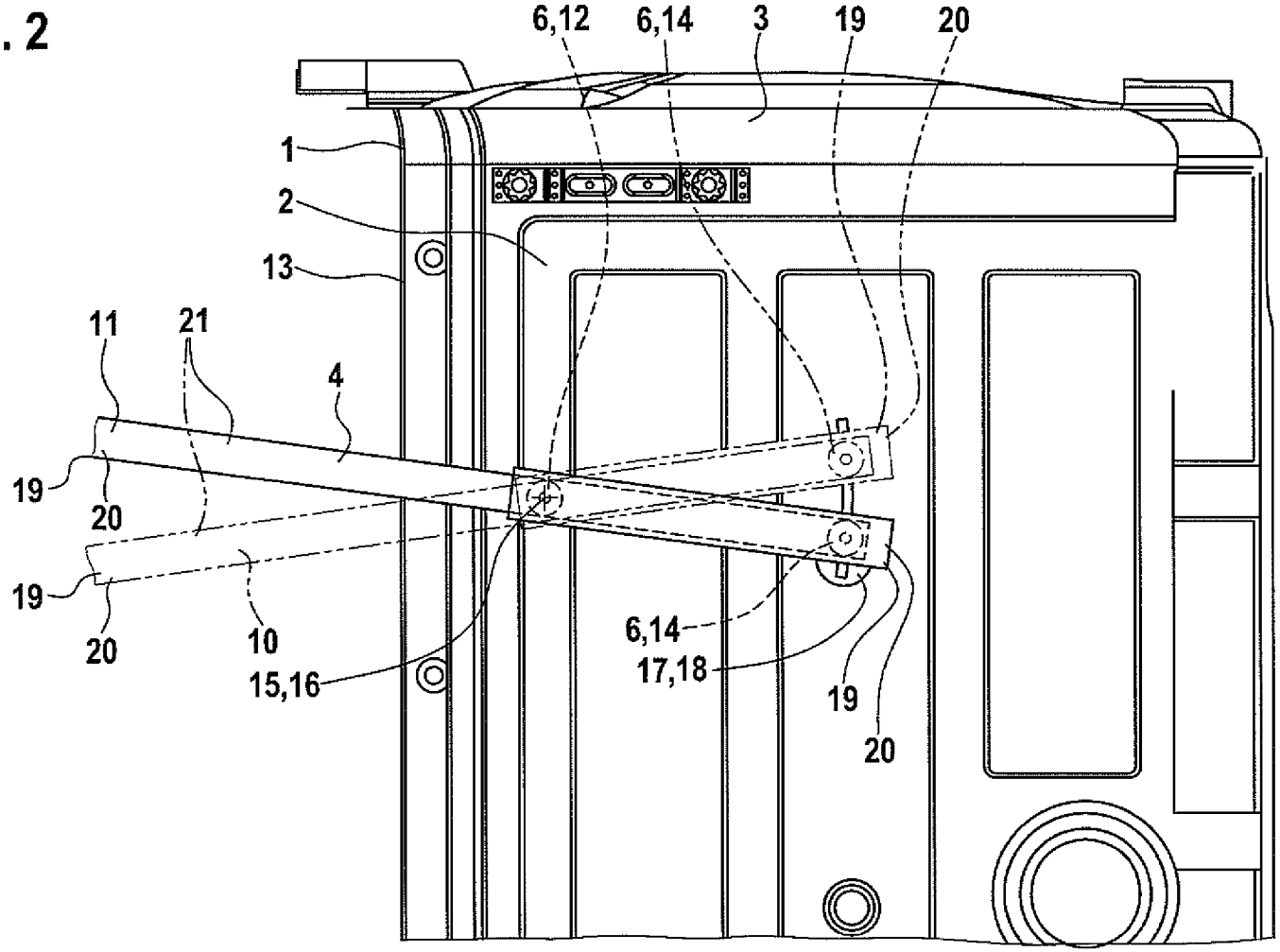
FIG. 2 shows a basic diagram of the rack guide rail, illustrating two pivot positions.

FIG. 2 shows the rack guide rail 4 in the wash compartment 2 of the dishwasher 1, with the rack guide rail 3 being shown twice for the purposes of illustration, specifically as a rack guide rail 10 in a first pivot position and as a rack guide rail 11 in a second pivot position. The first pivot position here can also be referred to as the move-out position and the second pivot position as the move-in position. An initial position between these, in which the rack guide rail 4 is in an essentially horizontal position, is not shown here but can be seen in FIG. 1. It can be seen from the diagram in FIG. 2 that the rack guide rails 10 and 11 are supported by means of the rollers 6 on the housing 3. Provision is made here for a front roller 12, which faces a wash compartment opening 13, and a rear roller 14, which faces away from the wash compartment opening 13. The front roller 12 here is supported rotatably in a fixed position, while the second rear roller 14 can be adjusted heightwise but is likewise disposed rotatably on the housing 3.

By setting the height of the second roller 14 it is possible to pivot the rack guide rail 4. When the second roller 14 is displaced upwards, the rack guide rail 4 is present in the first pivot position, in other words in the configuration of the rack guide rail 10. However when the second roller 14 is displaced downwards, the rack guide rail 4 pivots upwards, so that it is present in the second pivot position in the configuration of the rack guide rail 11. A pivot axis 15, about which the rack guide rail 4 pivots, is at the same time an axis of rotation 16 of the fixed roller 12. Displacing the second roller 14 heightwise therefore pivots the rack guide rail 4 about the pivot axis 15, so that the running surfaces 8 are no longer present essentially normal to a gravity vector. Gravity therefore brings about a displacement of the rack either out of the wash compartment 2 (in the presence of the first pivot position) or into it (in the presence of the second pivot position). The heightwise displacement of the second roller 14 is brought about by means of an actuator 17, which can be configured for example as an electric motor 18 (for example by way of a spindle gear (not shown)) or as an electromagnet (not shown) or an electromagnet arrangement.

A brake facility 20 (not shown in detail here) is preferably provided on the ends 19 of the rack guide rail 4. The brake facility 20 can be configured for example as an eddy current brake, gas pressure damper facility or oil pressure damper facility or at least comprise such. The brake facility 20 serves to slow the rack in relation to the rack guide rail 4, so that the rack does not come up against the stop element 9, as shown in FIG. 1, for example at too high a speed. This means that the brake facility 20 reduces the relative speed of the rack in relation to the rack guide rail 4 at least in the region of the ends 19, so that the speed and therefore the impetus of the rack is reduced before contact between a region of the rack and the stop element 9. This prevents damage to the rack guide rail 4, the rack and items disposed on the rack.

In the pivot positions the rack guide rail 4 or the running surfaces 8 form(s) a slanting plane 21, on which the rack can either enter or leave the wash compartment 2. Alternatively the height of the front roller 12 can also be set, while the rear roller 14 is supported in a fixed position but rotatably. With such an embodiment it is advantageous that the first pivot position, in other words the move-out position, can be reached by lowering the first roller 12. This is possible with little force outlay even with a fully loaded rack. In contrast to move the rack into the wash compartment 2 of the dishwasher 1 the roller 12 is displaced upwards, so that the second pivot position is present. This is generally performed when the rack has been unloaded after being moved out. The energy outlay for this operation is also relatively small.

Figure 3:
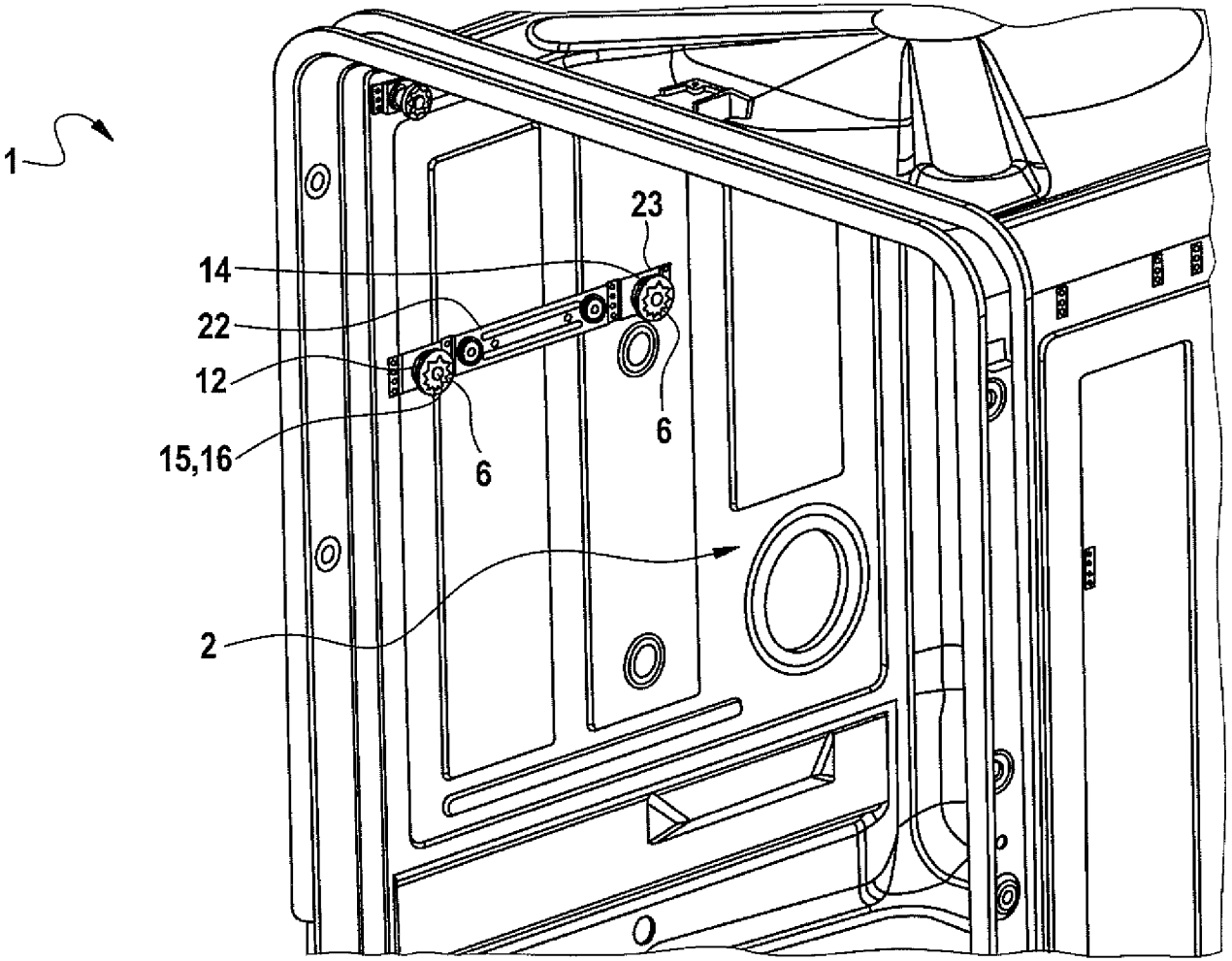
FIG. 3 shows a diagram of an adjustable roller holder.

FIG. 3 shows the wash compartment 2 of the dishwasher 1 without the rack guide rail 4 shown in FIGS. 1 and 2. Instead it shows a roller holder 22, on which the rollers 6 are supported rotatably, by means of which the rack guide rail 4 (not shown here) is held in a displaceable manner. The roller holder 22 here is configured so that the height of the rear roller 14 again is adjustable, in other words the axis of rotation 16 of the front roller 12 forms the pivot axis 15 of the rack guide rail 4 or of the roller holder 22. This means that the height of an end region 23 of the roller holder 22 pointing into the wash compartment 2 can be adjusted. The roller holder 22 as a whole pivots about the pivot axis 15, resulting in a simplified structure of the dishwasher 1 due to a greater degree of freedom when selecting the action position of the actuator 17 (not shown here) on the roller holder 22. It is of course also possible, as set out above, to dispose the front roller 12 so that it can be displaced heightwise and the rear roller 14 in a fixed position. Alternatively both rollers 12 and 14 can be displaced heightwise, provision preferably being made for this in an opposing manner. It is then advantageous for provision to be made for the roller holder 22 to be pivoted about its center point in an axial direction. If both rollers 12 and 14 can be displaced heightwise, the actuator 17 is assigned to the roller holder 22 and not to the rollers 6.

What is claimed is:

1. A dishwasher, comprising:

at least one wash compartment; and a rack guide rail for support in the wash compartment of a rack which holds items to be washed and/or dried, said rack guide rail having a running surface to allow movement of the rack in and out of the wash compartment for loading and unloading purposes along a travel path supported on the running surface, said rack guide rail being supported at a first support point for pivoting about a pivot axis, wherein the travel path extends at a sloped angle relative to horizontal to allow for gravity-assisted movement into and/or out of the wash compartment.

2. The dishwasher of claim 1, constructed in the form of a household dishwasher.

3. The dishwasher of claim 1, wherein the rack guide rail is pivotable about the pivot axis to move the running surface into an oblique position defined by a gradient that allows the rack to move into and/or out of the wash compartment due to gravity.

4. The dishwasher of claim 1, wherein the running surface is lowerable at least partially to change a slope of the running surface.

5. The dishwasher of claim 1, wherein the rack guide rail has a second support point at least on one of its end segments.

6. The dishwasher of claim 1, wherein the pivot axis is defined by a rotation point which is disposed in a center region of a longitudinal extension of the wash compartment in a direction of the travel path.

7. The dishwasher of claim 1, wherein the rack guide rail has a roller guide, which has at least one fixed first roller having an axis of rotation, said axis of rotation forming the pivot axis.

8. The dishwasher of claim 7, further comprising a housing, said first roller being supported rotatably on the housing.

9. The dishwasher of claim 8, wherein the roller guide has a second roller which is supported for displacement heightwise on the housing to guide the rack guide rail.

10. The dishwasher of claim 9, wherein the second roller is disposed at a distance from the first roller in a direction of the travel path.

11. The dishwasher of claim 1, further comprising an actuator for at least partial lowering of the travel path.

12. The dishwasher of claim 11, wherein the actuator is actively connected to the rack guide rail.

13. The dishwasher of claim 9, further comprising an actuator for at least partial lowering of the travel path, said actuator being actively connected to the second roller.

14. The dishwasher of claim 1, further comprising at least one member selected from the group consisting of at least one eddy current brake, a gas pressure damper facility, and a hydraulic damper facility to slow down a rack movement brought about by pivoting.

15. The dishwasher of claim 1, wherein the running surface is constructed to allow at least partial raising thereof.

16. A rack guide rail for a dishwasher, said rack guide rail supporting in a wash compartment of the dishwasher a rack which holds items to be washed and/or dried, said rack guide rail having a running surface to allow gravity-assisted movement of the rack in and/or out of the wash compartment for loading and/or unloading purposes along a travel path supported on the running surface, said rack guide rail being supported at a first support point for pivoting about a pivot axis to enable said rack guide rail to be sloped relative to horizontal.

17. The rack guide rail of claim 16, wherein the rack guide rail is pivotable about the pivot axis to move the running surface into an oblique position defined by a gradient that allows the rack to move into and/or out of the wash compartment due to gravity.

18. The rack guide rail of claim 16, wherein the running surface is lowerable at least partially to change a slope of the running surface.

19. The rack guide rail of claim 16, further comprising a second support point at least on an end segment of the rack guide rail.

20. The rack guide rail of claim 16, wherein the pivot axis is defined by a rotation point which is disposed in a center region of a longitudinal extension of the wash compartment in a direction of the travel path.

21. The rack guide rail of claim 16, further comprising a roller guide, which has at least one fixed first roller having an axis of rotation, said axis of rotation forming the pivot axis.

22. The rack guide rail of claim 21, wherein the first roller is supported rotatably on a housing of the dishwasher.

23. The rack guide rail of claim 21, wherein the roller guide has a second roller which is supported for displacement heightwise on a housing of the dishwasher to guide the rack guide rail.

24. The rack guide rail of claim 23, wherein the second roller is disposed at a distance from the first roller in a direction of the travel path.

25. The rack guide rail of claim 16, further comprising an actuator for at least partial lowering of the travel path.

26. The rack guide rail of claim 25, wherein the actuator is actively connected to the rack guide rail.

27. The rack guide rail of claim 23, further comprising an actuator for at least partial lowering of the travel path, said actuator being actively connected to the second roller.

28. The rack guide rail of claim 16, further comprising at least one member selected from the group consisting of at least one eddy current brake, a gas pressure damper facility, and a hydraulic damper facility to slow down a rack movement brought about by pivoting.

29. The rack guide rail of claim 16, wherein the running surface is constructed to allow at least partial raising thereof.

* * * * *